US008215522B2

(12) United States Patent
Breeser et al.

(10) Patent No.: US 8,215,522 B2
(45) Date of Patent: Jul. 10, 2012

(54) TRIGGER RELEASE MECHANISM FOR FLUID METERING DEVICE

(75) Inventors: David L. Breeser, Minneapolis, MN (US); Mark L. Bauck, Coon Rapids, MN (US); John C. Holman, Ham Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1042 days.

(21) Appl. No.: 12/214,698

(22) Filed: Jun. 20, 2008

(65) Prior Publication Data

US 2009/0314797 A1 Dec. 24, 2009

(51) Int. Cl.
*B67D 7/30* (2010.01)

(52) U.S. Cl. ..... 222/14; 222/20; 222/71; 222/153.14; 251/129.15

(58) Field of Classification Search ..... 222/14, 222/71, 153.12, 153.14; 251/129.15
See application file for complete search history.

(56) References Cited

U.S. PATENT DOCUMENTS

| | | | | |
|---|---|---|---|---|
| 4,109,686 | A * | 8/1978 | Phillips | 141/1 |
| 4,572,255 | A * | 2/1986 | Rabinovich | 141/217 |
| 4,883,199 | A * | 11/1989 | Ouarve et al. | 222/14 |
| 5,007,468 | A * | 4/1991 | Wilder et al. | 141/209 |
| 6,443,328 | B1 | 9/2002 | Fehl et al. | |
| 6,659,306 | B2 * | 12/2003 | Boyle et al. | 222/1 |
| 2006/0011652 | A1 | 1/2006 | King et al. | |

FOREIGN PATENT DOCUMENTS

| | | | |
|---|---|---|---|
| EP | 0787678 | A1 | 6/1997 |
| JP | 58072011 | A | 4/1983 |
| JP | 9169400 | A | 6/1997 |
| JP | 2005537189 | T | 12/2005 |

OTHER PUBLICATIONS

The Official Search Report and Written Opinion of the International Searching Authority in counterpart International Application No. PCT/US2009/003707 filed Jun. 22, 2009.

* cited by examiner

*Primary Examiner* — Kevin P Shaver
*Assistant Examiner* — Melvin Cartagena
(74) *Attorney, Agent, or Firm* — Kinney & Lange, P.A.

(57) ABSTRACT

A hand-held flow metering device for dispensing a pressurized fluid comprises a valve, a flow meter, a trigger lever, a trigger release mechanism and meter electronics. The valve is connected to the pressurized fluid to regulate flow of the pressurized fluid through the device. The flow meter is disposed within the flow of pressurized fluid to measure volumetric flow of the pressurized fluid. The trigger lever is configured to be manually displaced to mechanically open the valve. The trigger release mechanism is connected to the trigger lever and is selectively actuated to mechanically prevent the trigger lever from opening the valve when the trigger lever is displaced. The meter electronics is connected to the flow meter and the trigger release mechanism to actuate the trigger release mechanism based on output of the flow meter.

23 Claims, 7 Drawing Sheets

TRIGGER RELEASE MECHANISM FOR FLUID METERING DEVICE

CROSS-REFERENCE TO RELATED APPLICATION(S)

The present application is related to the following applications filed on the same day as this application: "SEAL-RETAINING VALVE FOR FLUID METERING DEVICE" by inventor D. Breeser (U.S. patent application Ser. No. 12/214,699), and "INVOLUTE GEAR TEETH FOR FLUID METERING DEVICE" by inventor D. Breeser (U.S. patent application Ser. No. 12/214,669).

BACKGROUND

The present invention is directed toward fluid dispensing meters and more particularly to trigger release mechanisms for such devices. Hand-held devices are often used to dispense measured amounts of fluid from bulk containers. For example, automotive service stations frequently use hand-held meters to dispense small quantities of lubricating oil from large drums into automotive engines. Such hand-held meters and other similar fluid dispensing devices typically include a dispensing valve having a linearly actuated valve stem that rides within a valve cartridge. The valve cartridge is fluidly connected to a source of pressurized fluid within the device, while the valve stem is actuated by an operator to regulate pressurized fluid flow through the valve cartridge. As such, fluid can be continuously dispensed from the device so long as an operator continues to actuate the valve stem, typically through a trigger lever mechanism. In order to monitor fluid consumption, hand-held meters typically include electronics that measure and display the volume of fluid that flows through the device so that an operator is permitted to accurately dispense fluid on a job-by-job basis.

Accountability of fluid consumption is becoming a greater concern, particularly as the cost of materials such as fossil fuels continues to rise. One way of maintaining control over fluid inventories is to prevent unauthorized dispensing of fluid from hand-held meters through use of various dispensing control mechanisms, such as trigger lockouts or solenoid dispensing valves, that are remotely controlled through the meter electronics. With a trigger lockout, an electric actuator is controlled by the meter electronics, which is programmed to move a physical barrier into the path of a trigger lever to inhibit opening of the dispensing valve after a preset amount of fluid is dispensed. Trigger lockouts, however, require the trigger to be released before the physical barrier can be moved into the path of the trigger, thus permitting fluid to flow after the preset amount has been dispensed so long as the trigger remains actuated. With a solenoid dispensing valve, the meter electronics controls a solenoid valve to permit fluid flow, independently of actuation of an electronic trigger mechanism. Thus, the meter electronics can override the electronic trigger mechanism to permit dispensing only when authorized. Such solenoid valves, however, require continuous power consumption to overcome a spring force holding the valve shut, thus placing a large demand on rechargeable batteries used to power the electronics. There is, therefore, a need for an improved dispensing control mechanism, particularly for those used in fluid metering devices.

SUMMARY

The present invention is directed to a hand-held flow metering device for dispensing a pressurized fluid. The metering device comprises a valve, a flow meter, a trigger lever, a trigger release mechanism and meter electronics. The valve is connected to the pressurized fluid to regulate flow of the pressurized fluid through the device. The flow meter is disposed within the flow of pressurized fluid to measure volumetric flow of the pressurized fluid. The trigger lever is configured to be manually displaced to mechanically open the valve. The trigger release mechanism is connected to the trigger lever and is selectively actuated to mechanically prevent the trigger lever from opening the valve when the trigger lever is displaced. The meter electronics is connected to the flow meter and the trigger release mechanism to actuate the trigger release mechanism based on output of the flow meter.

DETAILED DESCRIPTION

Figure 1:
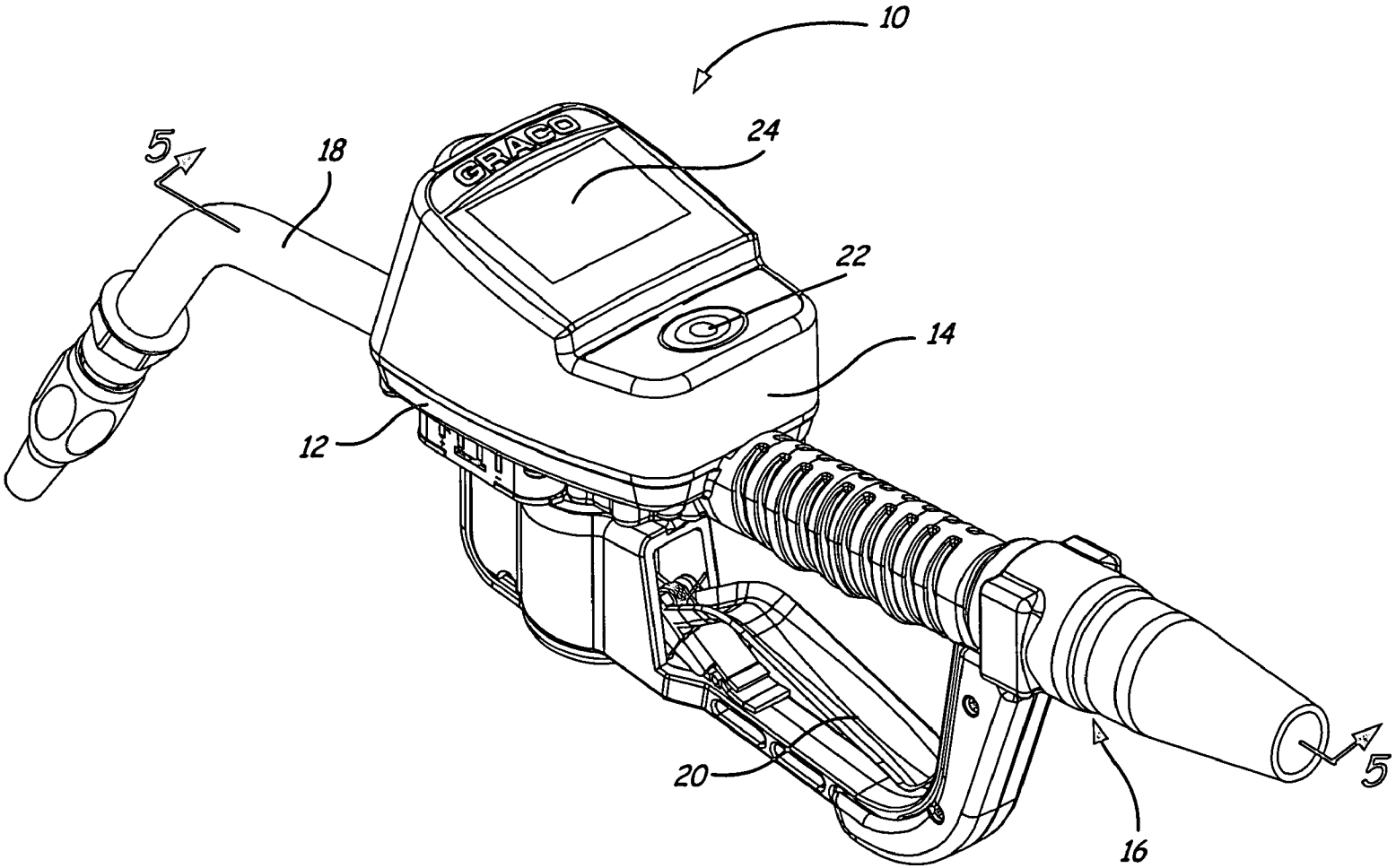
FIG. 1 shows a perspective view of a hand-held fluid dispensing device in which a trigger release mechanism of the present invention is used.

FIG. 1 shows a perspective view of hand-held fluid dispensing device 10 in which a trigger release mechanism of the present invention is used to limit fluid dispensing by device 10. Dispensing device 10 includes platform 12, cover 14, high pressure fluid coupling 16, dispensing tube 18, trigger lever 20, user interface 22 and display 24. Dispensing device 10 permits fluid stored in a large-volume container to be distributed in smaller volumes in a convenient manner. For example, in one embodiment, dispensing device 10 comprises a meter used in lubrication shops to deliver small quantities of lubricating oil from a storage drum to a vehicle engine. Coupling 16 is connected to the large-volume container through a fluid handling hose (not shown), which is pressurized using, for example, an air operated pump. The length of the hose enables device 10 to conveniently reach locations to which it is impractical to move the large-volume container. Dispensing tube 18 is configured to be easily: positioned within an opening of a small-volume container, such as an engine crankcase, into which a measured amount of the fluid is to be dispensed. Trigger lever 20 is displaced by an operator to open a valve in platform 12 and dispense fluid from the large-volume container to the small-volume container at dispensing tube 18. User interface 22 and display 24, which are connected to electronics within cover 14, permit the operator to monitor dispensed fluid quantity, process job orders, collect billing and inventory data, communicate with a central control system and perform other similar functions. The trigger release mechanism of the present invention, which is mounted to platform 12 and connected to the electronics under cover 14, selectively prevents displacement of trigger lever 20 from opening the valve to dispense fluid. For example, in one embodiment, an operator uses interface 22 to program the electronics to activate the trigger release mechanism after a preset amount of fluid is dispensed to complete a job order. Furthermore, in other embodiments, the central control system communicates with the electronics to activate the trigger release mechanism to disable trigger lever 20 until a new job order is received.

Figure 2:
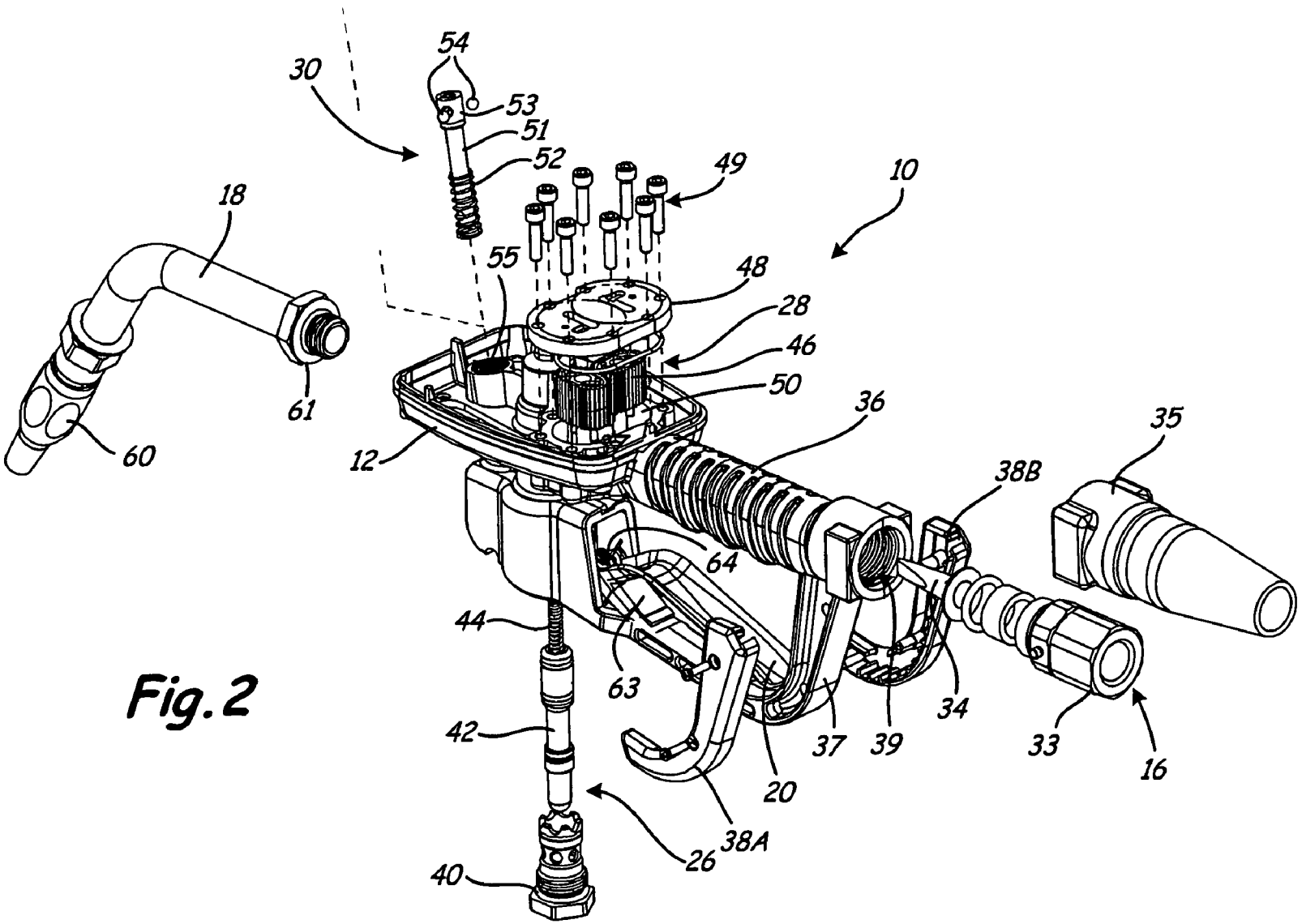
FIG. 2 shows a rearward exploded view of the hand-held fluid dispensing device of FIG. 1 showing a trigger release mechanism of the present invention and a fluid dispensing valve.
Figure 3:
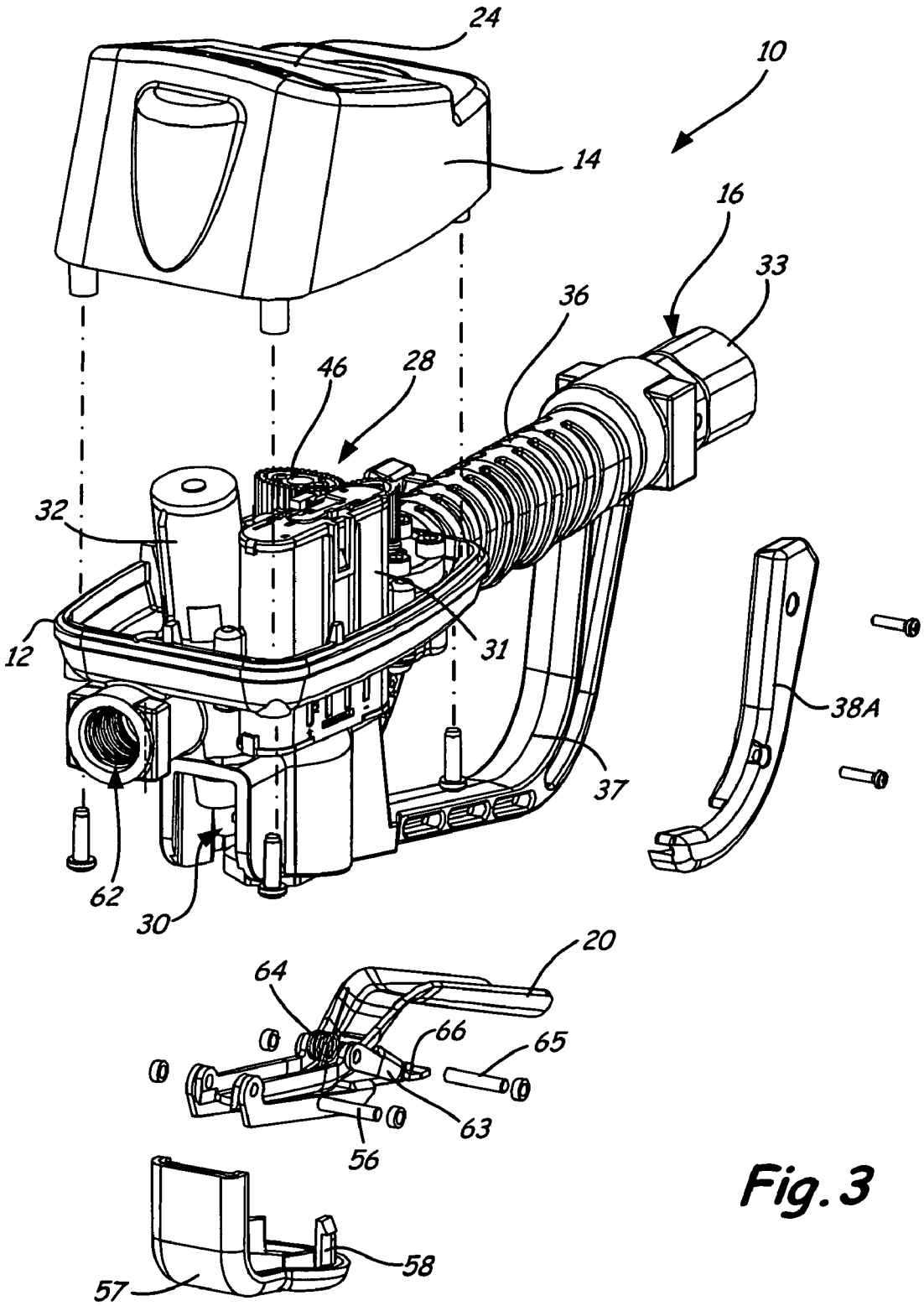
FIG. 3 shows a forward exploded view of the hand-held fluid dispensing device of FIG. 1 showing a trigger release mechanism of the present invention and a trigger lever mechanism.

FIGS. 2 and 3 show exploded views of dispensing device 10 of FIG. 1. FIG. 2 shows a rearward view of device 10 in which seal-retaining valve 26, flow meter 28 and trigger release 30 are shown. FIG. 3 shows a forward view of device 10 in which cover 14, flow meter 28, trigger release 30, battery 31 and solenoid 32 are shown. Fluid coupling 16, which includes swivel fastener 33, filter 34 and hose shroud 35, is connected to handle portion 36 of platform 12. Specifically, external threads on fastener 33 join with internal threads within high-pressure fluid passage 39, inside of handle portion 36. Handle portion 36 includes trigger guard 37, which includes pads 38A and 38B, to prevent accidental actuation of trigger 20 and valve 26. Valve 26, which includes valve cartridge 40, valve stem 42 and valve spring 44, is positioned within platform 12 to interrupt flow between passage 39 and tube 18. Flow meter 28 includes gears 46, cover 48 and fasteners 49. Gears 46 are positioned within gear box 50 to engage fluid flowing between coupling 16 and valve 26. Gear box 50 is sealed with cover 48, which is secured with fasteners 49. Trigger release 30, which includes trip rod 51, spring 52, collar 53 and bearings 54, is positioned within bore 55, at the base of which trip rod 51 connects to trigger lever 20. Trigger lever 20 is joined to trip rod 51 with trigger pin 56 to form a pivoting connection, which is enclosed within platform 12 by guard 57. Guard 57 includes frangible tabs 58 that, once installed, must be broken to remove guard 57 from platform 12. From pin 56, trigger lever 20 extends through platform 12 between handle portion 36 and trigger guard 37, engaging valve stem 42 along the way. Dispensing tube 18, which includes nozzle 60 and coupling 61, is connected to low pressure fluid passage 62 within platform 12. Specifically, external threads on coupling 61 join with internal threads within low pressure fluid passage 62.

Trigger lever 20 actuates seal-retaining valve 26 to permit fluid to be dispensed over a range of rates; the further trigger lever 20 is displaced, the more fluid is dispensed at tube 18. Trigger lever 20 can be maintained in an actuated position such that valve 26 remains open using trigger lock 63 and spring 64, which are joined to trigger lever 20 with pin 65. Trigger lock 63 engages ratchet plate 66, which is jointed to trigger lever 20 at pin 56. Valve 26 of device 10 is sized to dispense a high-volumetric output of fluid, such as approximately 14 gpm (gallons per minute) [~883.6 cc/s (cubic centimeters per second)] or more, which is typically achieved using high fluid pressures. High fluid pressures enable dispensing device 10 to more rapidly dispense fluid to save time, and to more easily dispense highly viscous fluids. In conjunction with meter electronics, flow meter 28 monitors the rate at which the fluid flows through valve 26 to permit precise quantities of fluid to be accurately dispended by actuation of trigger lever 20. Also in conjunction with meter electronics, trigger release 30 prevents over-dispensing by disabling trigger lever 20 after a set amount of fluid has been dispensed, and prevents unauthorized dispensing by maintaining trigger lever 20 disabled until a new job order is received. Thus, fluid dispensing device 10 coordinates the use of metered distribution and a dispensing control mechanism to reduce waste fluid and other sources of inventory shrinkage.

Figure 4:
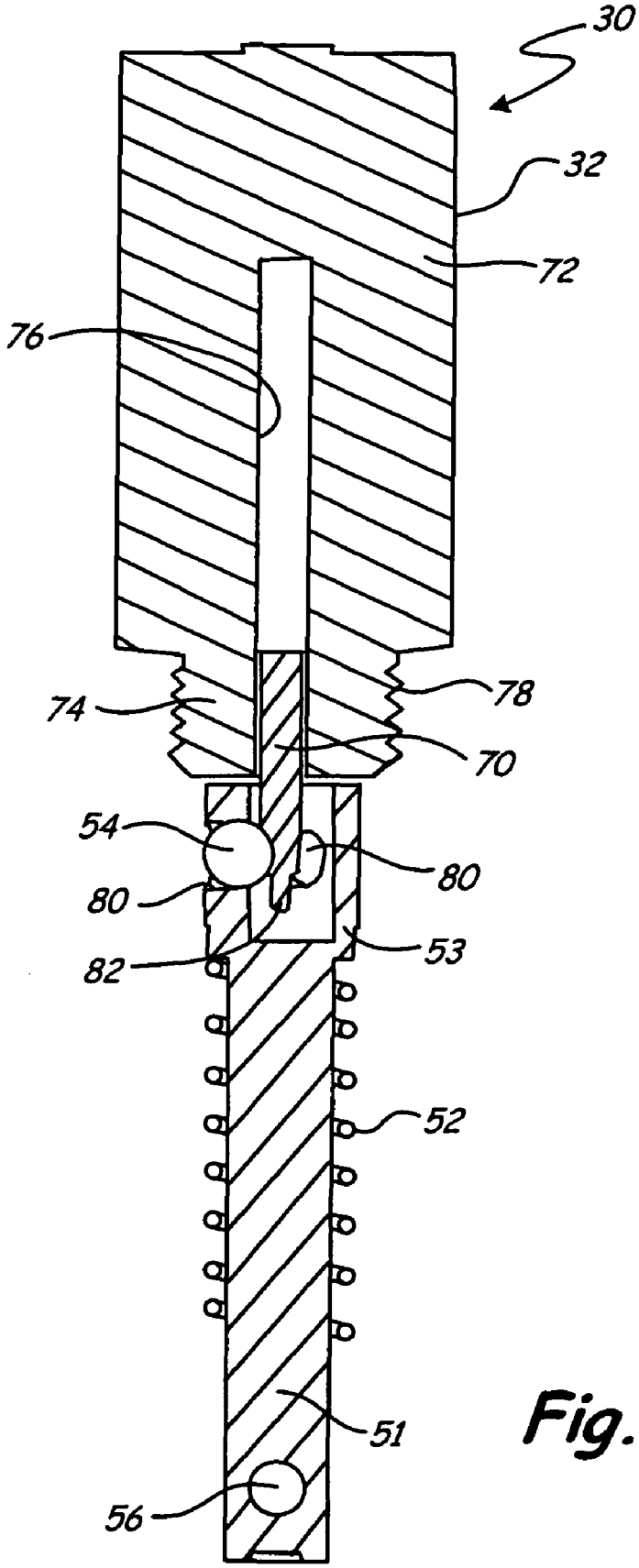
FIG. 4 shows a cross sectional view of the trigger release mechanism of FIGS. 2 and 3.

FIG. 4 shows a close up cross sectional view of trigger release mechanism 30 of FIGS. 2 and 3. Trigger release mechanism 30 includes solenoid 32, trip rod 51, release spring 52, collar 53, bearings 54, trigger pin 56 and plunger pin 70. Assembled as shown, solenoid 32 is configured to be mounted to bore 55 (FIG. 2) in platform 12, and trip rod 51 is configured to be inserted through bore 55 and connected to trigger lever 20 at pin 56.

Solenoid 32 includes actuation housing 72, neck 74 and pin channel 76, which extends through neck 74 and into housing 72. Neck 74 includes external threads 78, which are threaded into bore 55 (FIG. 2) within platform 12 to mount actuation housing 72 and plunger pin 70 linearly atop bore 55. Plunger pin 70 is disposed within pin channel 76 and is configured to interact with actuation means within actuation housing 72 to slide within pin channel 76. Actuation housing 72 stores components that are assembled to form an electric actuation mechanism for traversing plunger pin 70 within pin channel 76 between first and second positions. In the first position, plunger pin 70 is extended, as shown in FIG. 4, to emanate from neck 74. In the second position, plunger pin 70 is withdrawn into neck 74 by the actuation means within housing 72. In one embodiment, solenoid 32 comprises a conventional solenoid actuation mechanism in which an electrical current is applied to a coil to electro-magnetically bias plunger pin 70 in the extended position, and a spring force traverses plunger pin 70 to the withdrawn position when the electric current is removed. In another embodiment, solenoid 32 comprises a latching solenoid in which a spring force biases plunger pin 70 in the extended position, a permanent magnet retains plunger pin 70 in the withdrawn position, and an electromagnet is intermittently activated to transition plunger pin 70 between the first and second positions. One such latching solenoid suitable for use in the present invention is described in U.S. Pat. No. 6,392,516 by Ward et al. and assigned to TLX Technologies, Waukesha, Wis. With a latching solenoid, device 10 does not require constant power to activate solenoid 32 to dispense fluid, as a conventional solenoid requires. Solenoid 32 is connected to meter electronics within device 10 to actuate plunger pin 70 either by operator command or through a central control system.

Trip rod 51 is disposed within bore 55 to interact with plunger pin 70. Specifically; collar 53 is connected to a first end of trip rod 51 to releasably engage plunger pin 70 when in the extended position. A second end of trip rod 51 is connected to trigger lever 20 with trigger pin 56. Release spring 52 is positioned around trip rod 51 and is biased between collar 53 and platform 12 to push trip rod 51 into engagement with neck 74 of solenoid 32. Collar 53 includes a plurality of bores 80 into which a plurality of ball bearings 54 are disposed. In one embodiment, collar 53 includes three bearings 54 and three bearing bores 80. Bores 80 are disposed approximately equidistant around the perimeter of collar 53, i.e. about 120 degrees apart. Bores 80 comprise holes that extend through collar 53 to limit movement of bearings 54 to only along the centerlines of bores 80, which produces radial movement from the centerline of trip rod 51. To facilitate assembly with platform 12, bores 80 are tapered, rounded or otherwise reduced in diameter nearer the interior of collar 53 to prevent bearings 54 from falling into collar 53. For example, in one embodiment, bores 80 are produced with a ball-end milling process to produce the tapered shape. In any embodiment, the diameter of bearings 54 is greater than the depth of bores 80 such that bearings 54 must at least partially extend beyond the interior or exterior surface of collar 53. Bearings 54 are permitted to partially extend from bores 80 to partially enter collar 53 and engage tip 82 of plunger pin 70. Bearings 54 are also permitted to extend from bores 80 outside of collar 53 to engage bore 55. Plunger pin 70 is ramped down toward tip 82 to facilitate insertion and removal of plunger pin 70 from between bearings 54.

With plunger pin 70 in the first or extended position, tip 82 of plunger pin 70 wedges bearings 54 against walls of bore 55 to suspend trip rod 51 within bore 55, as will be explained in greater detail with respect to FIG. 5A. With plunger pin 70 in the second or withdrawn position, bearings 54 are freely floating within bores 80 and trip rod 51 is free to float within bore 55, as will be explained in greater detail with respect to FIG. 5C.

Figure 5A:
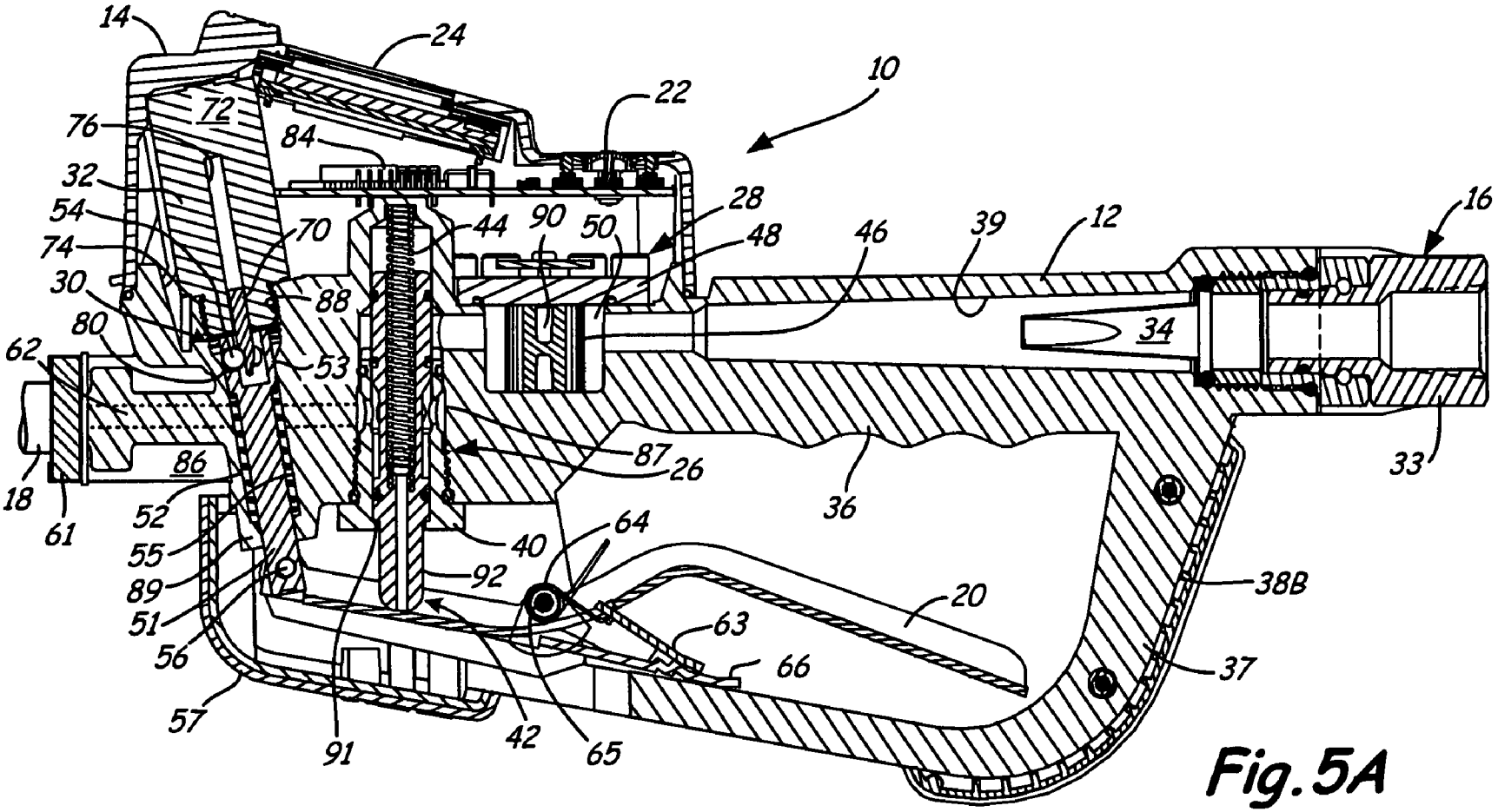
FIG. 5A shows a cross sectional view of the hand-held fluid dispensing device of FIG. 1 in which a trigger release mechanism is configured to permit a trigger lever mechanism to actuate a fluid dispensing valve.

FIG. 5A shows a cross section of fluid dispensing device 10 taken at section 5-5 of FIG. 1, in which trigger release mechanism 30 is configured to permit trigger lever 20 to actuate a fluid dispensing valve. Dispensing device 10 includes platform 12, cover 14, fluid coupling 16, dispensing tube 18, trigger lever 20, user interface 22, display 24, seal-retaining valve 26, flow meter 28, trigger release 30 and electronics 84. Valve 26 includes valve cartridge 40, valve stem 42 and valve spring 44. Flow meter 28 includes gears 46, cover 48 and fasteners 49. Trigger release mechanism 30 includes solenoid 32, trip rod 51, release spring 52, collar 53, bearings 54, trigger pin 56 and plunger pin 70.

Platform 12 includes handle portion 36, which includes high-pressure fluid passage 39, and dispensing portion 86, which includes low-pressure fluid passage 62 (which is shown in hidden lines in FIG. 5 and visible behind dispensing portion 86 in FIG. 3). High-pressure fluid passage 39 is in fluid communication with low-pressure fluid passage 62 through valve 26 to conduct fluid from coupling 16 to dispensing tube 18. High-pressure fluid passage 39 extends centrally through platform 12 within handle portion 36 and intersects valve 26. Low-pressure fluid passage 62 extends tangentially from valve 26, past bore 55 to dispensing tube 18, parallel to high-pressure fluid passage 39. Fluid coupling 16 is connected to an upstream end of fluid passage 39 through a threaded engagement. Gears 46 of flow meter 28 are disposed within gear box 50 positioned within a middle portion of passage 39. Gear box 50 is covered and sealed by lid 48. Seal-retaining valve 26 and trigger release 30 are disposed within bores 87 and 55, respectively, which extend into platform 12. Valve bore 87 extends approximately transversely into platform 12 to approximately perpendicularly intersect high-pressure fluid passage 39. An upper portion of bore 87 connects to the downstream end of passage 39, and a lower portion of bore 87 connects to the upstream end of passage 62. Release bore 55 extends into platform 12 approximately five degrees offset from vertical with respect to fluid passage 39. Release bore 55 does not intersect high-pressure fluid passage 39 or low-pressure fluid passage 62. An upper portion of release bore 55 comprises a threaded counterbore to form seat 88 for receiving neck 74 of solenoid 32. Middle portion of release bore 55 is sized to slidably receive release spring 52 and collar 53. Lower portion 89 of release bore 55 is sized to slidably receive only trip rod 51 such that spring 52 is positioned between platform 12 and collar 53. Coupling 61 is connected to a downstream end of passage 62 to guide fluid from device 10 through dispensing tube 18.

Meter 28 is positioned within passage 39 between fluid coupling 16 and dispensing valve 26. Meter 28 generally comprises a set of positive displacement gears 46 that are rotated by the flow of pressurized fluid from coupling 16 within gear box 50. Each gear 46 includes a sensor or magnet 90, the position of which is detectible by electronics positioned within lid 48 to determine the rotational speed of gear 46. Lid 48 is connected to electronics 84 such that the rotational speed of gears 46 can be converted to a volumetric flow rate of fluid passing through high-pressure fluid passage 39. Further explanation of meter 28 is found in the aforementioned co-pending application entitled "INVOLUTE GEAR TEETH FOR FLUID METERING DEVICE" which is herein incorporated by reference.

Valve 26 is positioned within bore 87 to regulate flow between passage 39 and passage 62. With valve spring 44 inserted into valve stem 42 and valve stem 42 inserted into valve cartridge 40, external threads on valve cartridge 40 are threaded into bore 87 within platform 12. Inserted as such, valve spring 44 engages a dead-end of bore 87 within platform 12 and is compressed to bias valve stem 42 toward valve cartridge 40. Valve cartridge 40 includes lip 91 that engages a lip on valve stem 42 to prevent valve stem 42 from passing through valve cartridge 40. Actuation portion 92 of valve stem 42 extends from bore 87 through valve cartridge 40 to engage trigger lever 20. Further explanation of dispensing valve 26 is found in the aforementioned co-pending application entitled "SEAL-RETAINING VALVE FOR FLUID METERING DEVICE" which is herein incorporated by reference.

Trigger release 30 includes solenoid 32, trip rod 51, spring 52, collar 53, bearings 54 and plunger pin 70, and is configured to disable trigger lever 20 after a threshold amount of fluid has passed through meter 28. Solenoid 32 is mounted atop platform 12 such that plunger pin 70 is extendable into release bore 55 to engage trip rod 51. Neck 74 of solenoid housing 72 is threaded into release bore 55 so that solenoid housing 72 extends up from platform 12 and plunger bore 76 is aligned with release bore 55. Plunger pin 70 is extended from plunger bore 76 to releasably engage collar 53 of trip rod 51. Trip rod 51 extends through bore 55 to join with plunger pin 70 at a first end and trigger lever 20 at a second end. Specifically, bearings 54 within bores 80 of collar 53 engage plunger pin 70 at the first end, and pin 56 extends through trip rod 51 and trigger lever 20 at the second end. Trigger lever 20 extends generally laterally from pin 56 to engage valve 26. Trigger lock 63 is connected to trigger lever 20 at pin 65, and ratchet plate 65 is connected to trigger lever 20 at pin 56. Trigger release mechanism 30 selectively connects trigger lever 20 to platform 12 to provide a fixed pivot point for actuation of trigger lever 20.

Solenoid 32 is connected to electronics 84, which includes software, circuitry and other components that are programmable to control device 12. Additionally, in other embodiments, electronics 84 includes other components for communicating over a wired network, a wireless network or radio network such that device 12 can send and receive information, such as work orders and fluid consumption quantities, to and from a computer system. Device 10 also includes battery 31 (FIG. 3) for operating interface 22, display 24, solenoid 32, electronics 84 and any other electrical component of device 10. Solenoid 32 comprises a two way electromagnetic device that is activated by electronics 84 to alternate the position of plunger pin 70 between being withdrawn into solenoid 32 and being extended into bore 55.

Solenoid 32 is actuated to permit manual dispensing of fluid with trigger lever 20 after electronics 84 receive authorization over the communications network for a new job order. In the embodiment using a latching solenoid, a momentary positive voltage is applied across an electromagnetic coil to disengage plunger pin 70 from a permanent magnet within housing 72 that retains plunger pin 70 in the withdrawn position. The electromagnetic force of the coil overcomes the force of the permanent magnet to permit a spring force to bias plunger pin 70 to the extended position, as shown in FIG. 5A. As such, plunger pin 70 engages bearings 54 and pushes bearings 54 into collar 53 such that movement of bearings 54 toward each other within collar 53 is inhibited. Bearings 54 partially extend from bores 80 to engage the wall of bore 55. The spring force of solenoid 32 is large enough to part bearings 54 and wedge bearings 54 between plunger pin 70 and bore 55. Trip rod 51 is thus prevented from moving downward by bearings 54 and upward by solenoid 32. Specifically, trip rod 51 is suspended from bearings 54 such that the second end of trip rod 51 at pin 56 is stationary with respect to its axial position within bore 55. Thus, trigger lever 20 is permitted to pivot about pin 56 and can be actuated to open valve 26.

Figure 5B:
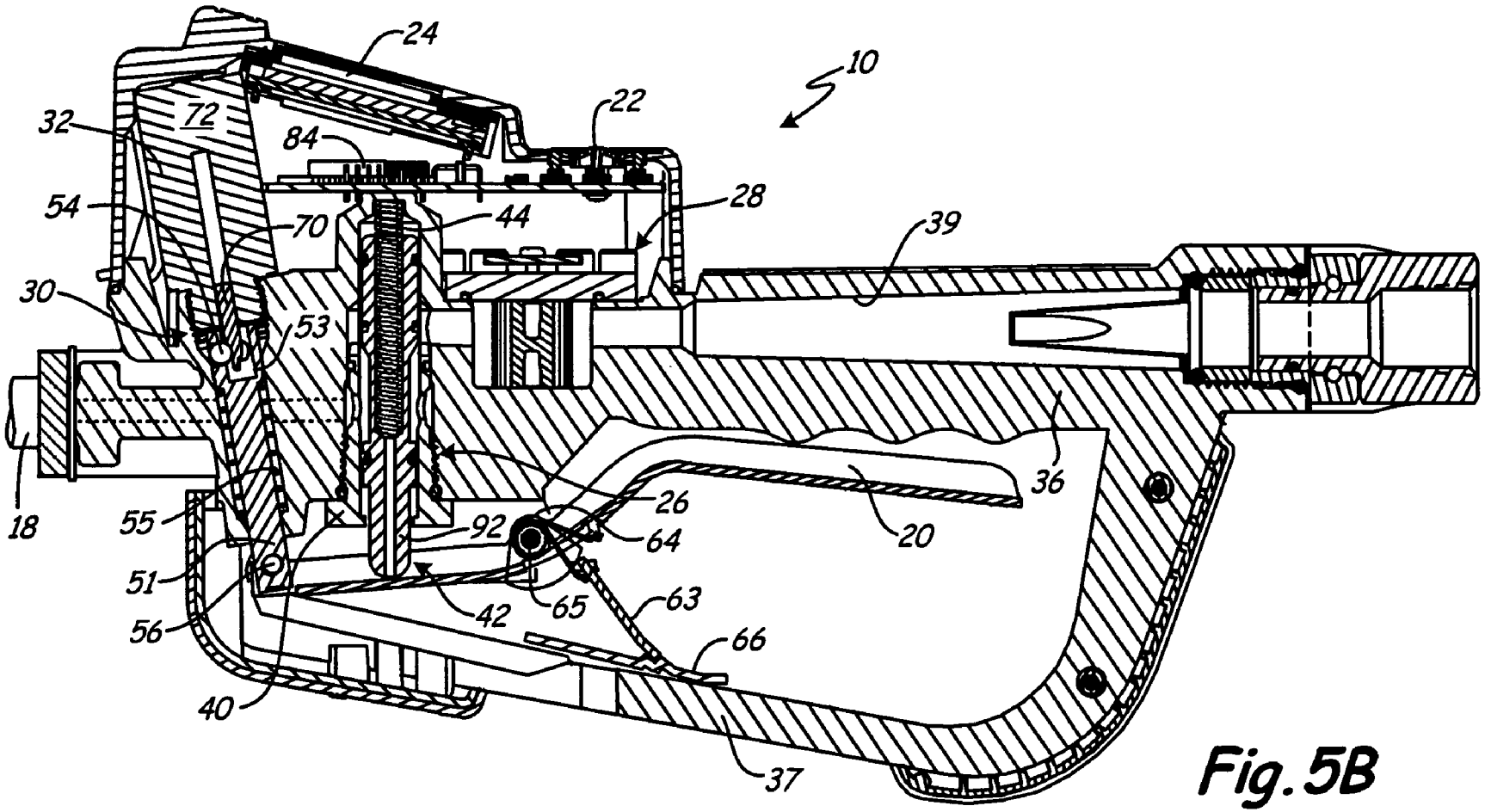
FIG. 5B shows a cross sectional view of the hand-held fluid dispensing device of FIG. 1 in which in which a trigger lever mechanism is pivoted at the trigger release mechanism to open a fluid dispensing valve.

FIG. 5B shows a cross section of fluid dispensing device 10 taken at section 5-5 of FIG. 1, in which trigger lever 20 is pivoted about trip rod 51 to displace valve stem 42 of dispensing valve 26. Specifically, trigger lever 20 is brought toward handle portion 36 by an operator to push actuation portion 92 of valve stem 42 into valve cartridge 40 to allow fluid to flow into low-pressure fluid passage 62 from high-pressure fluid passage 39. The fixed position of pin 56 and the mechanical leverage gained by trigger lever 20 permits the resistance of valve spring 44 to be overcome. Plunger pin 70 of trigger release mechanism 30 is retained in the extended position through a spring force or electromagnetic force generated by the solenoid mechanism within solenoid housing 72, depending on the embodiment. Plunger pin 70 maintains bearings 54 pinned against bore 55 to prevent downward movement of trip rod 51.

Trigger lock 63 comprises a jack plate that is employed in conjunction with ratchet plate 66 to prop trigger lever 20 in a position to maintain valve:26 opened, which is particularly convenient for dispensing large quantities of fluid without the need for supervision of device 10. As lever 20 is rotated up, ratchet plate 66 pivots about pin 56 and slides along trigger guard 37, while trigger lock 63 is pulled up from trigger guard 37 at pin 65 and rotated downward to engage ratchet plate 66. Ratchet plate 66 includes corrugations or some other such ledges against which trigger lock 63 is propped up against. Lock spring 64 biases trigger lock 63 toward lever 20, but is prevented from doing so by engagement with ratchet plate 66. Lever 20 is propped upward to continuously retain valve 26 open through the leverage gained by fixing trigger pin 56 above actuation portion 92 of valve stem 42, thus permitting fluid to continuously flow from tube 18.

Trigger lock 63 can be manually disengaged and trigger lever 20 manually lowered to close valve 26, as shown in FIG. 5A, after the desired amount of fluid is dispensed from device 10. For example, using meter 28 and electronics 84, display 24 outputs the total dispensed fluid volume of device 10 for the particular job order. After the desired amount of fluid is dispensed, the operator simply disengages trigger lock 63 from ratchet plate 66 and disengages lever 20 from valve stem 42 by rotating lever 20 about trigger pin 56. The force of valve spring 44 pushes actuation portion 92 of valve stem 42 out of valve cartridge 40 to close valve 26. Trigger release mechanism 30 of the present invention, however, enables electronics 84 to activate solenoid 32 to automatically close valve 26, independent of the actuated position of trigger lever 20. For example, using interface 22 and display 24, an operator can program device 10 to dispense a preset volume of fluid. After a set amount of fluid has passed through valve 26, as measured by meter 28, trigger release 30 is actuated by electronics 84 to withdraw plunger pin 70 from collar 53.

Figure 5C:
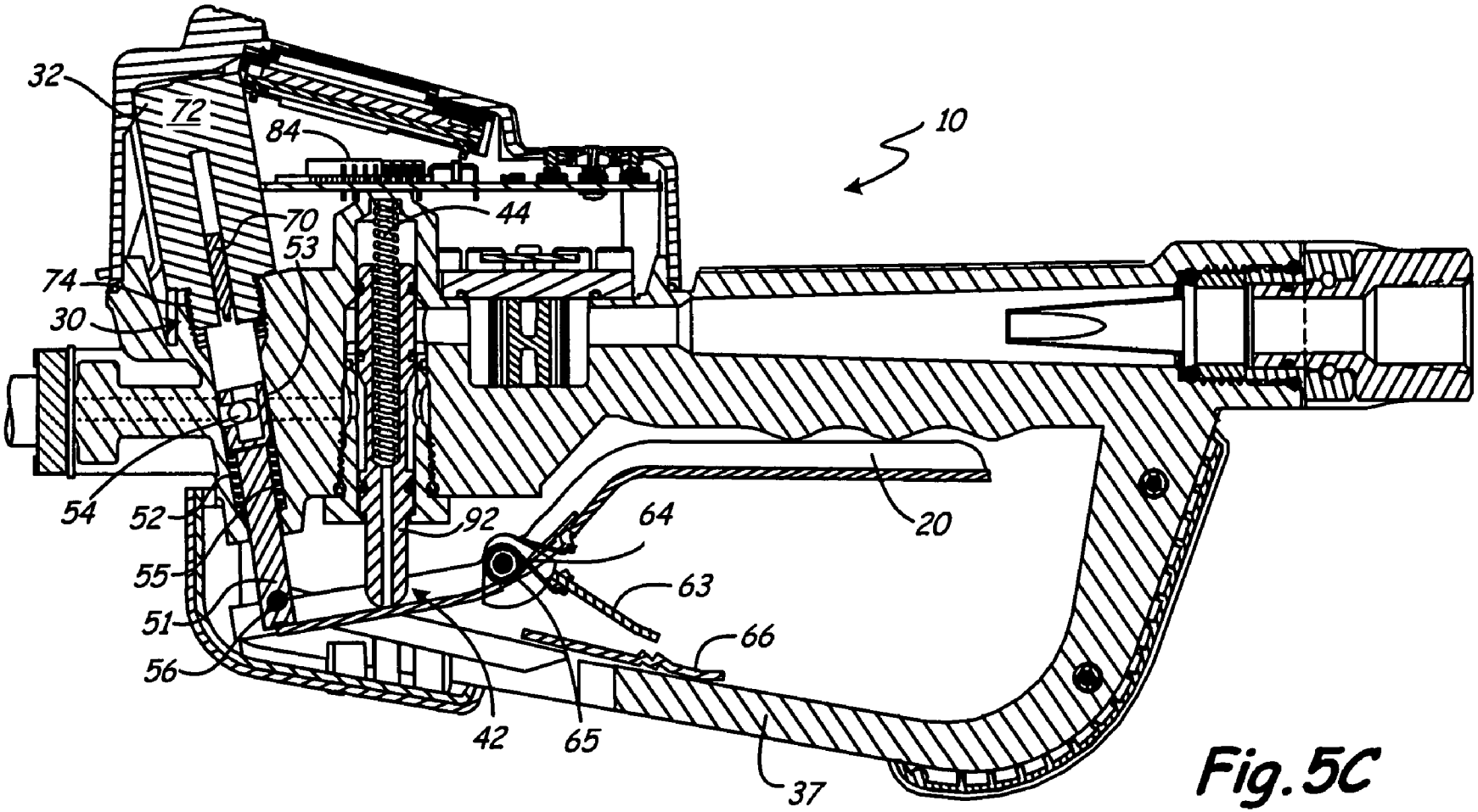
FIG. 5C shows a cross sectional view of the hand-held fluid dispensing device of FIG. 1 in which a trigger release mechanism is configured to prevent a trigger lever mechanism from actuating a fluid dispensing valve.

FIG. 5C shows a cross sectional view of fluid dispensing device 10 taken at section 5-5 of FIG. 1, in which trigger release mechanism 30 is configured to prevent trigger lever 20 from actuating fluid dispensing valve 26. FIG. 5C shows device 10 in the moments immediately after electronics 84 determines that device 10 has dispensed the preset amount of fluid, and solenoid 32 is activated to withdraw plunger pin 70 from collar 53. As such, valve stem 42 and trip rod 51 are forced downward by valve spring 44 and trigger lever 20 is transitioning from the actuated to the un-actuated position. In the embodiment using a latching solenoid, a momentary negative voltage is applied across an electromagnetic coil to overcome a spring force biasing plunger pin 70 in the extended position. The electromagnetic force of the coil pushes plunger pin 70 to engage a permanent magnet within housing 72 and retain plunger pin 70 in the withdrawn position, as is shown in FIG. 5C. The ramped surface of tip 82 (FIG. 4) of plunger pin 70 facilitates withdrawal of plunger pin 70 from between bearings 54 by producing a component of upward force from bearings 54 along plunger pin 70 to reduce the force solenoid 32 is required to generate. When plunger pin 70 is withdrawn, bearings 54 are permitted to retreat within collar 53 to touch each other. Thus, bearings 54 do not extend beyond the outer edge of bores 80 and are no longer pinned against bore 55. Trip rod 51 is therefore permitted to freely slide within bore 55, un-fixing the pivot point for trigger lever 20 at trigger pin 56. The force of valve spring 44 pushes trigger pin 56 and trigger lever 20 down toward trigger guard 37, pulling trip rod 51 along. Thus, trigger pin 56 is positioned below actuation portion 92, eliminating the mechanical advantage of trigger lever 20 with respect to actuation portion 92 of valve stem 42. Release spring 52 is positioned between collar 53 and platform 12 to push trip rod 51 back into engagement with neck 74 of solenoid 32 after trigger lever 20 is released. The spring force of valve spring 44 is relatively stronger than the spring force of release spring 52. Even though trigger lever 20 is partially actuated, valve 26 is closed. Any further actuation of trigger lever 20 will only produce rotation of trigger lever 20 about dispensing portion 92, rather than cause valve spring 44 to compress.

Trigger release mechanism 30 operates regardless of the position of trigger lever 20. Trip rod 51 uncouples the forward end of lever 20 such that manipulation of the aft end of lever 20 is prevented from having the ability to actuate valve stem 42. Thus, if an operator were retaining trigger lever 20 in the actuated position, withdrawal of plunger pin 70 from collar 53 would still allow valve stem 42 to push trip rod 51 away from solenoid 32. If trigger lever were released, upward force from release spring 52 would return trip rod 51 to solenoid 32. Likewise, if trigger lock 63 was configured to retain trigger lever 20 in the actuated position, such as in FIG. 5B, withdrawal of plunger pin 70 from collar 53 would still allow valve stem 42 to push trip rod 51 away from solenoid 32 and return trigger lever 20 to the un-actuated position. The downward force of valve stem 42 after plunger pin 70 is withdrawn produces a momentary downward movement of trip rod 51, which produces rotational movement of trigger lever 20 about actuation portion 92 of valve stem 26 due to the angular orientation of release bore 55. The momentary angular rotation of trigger lever 20 produces a slight relative forward movement of trigger lock 63 with respect to ratchet plate 66 due to the different positions of pins 56 and 65 about trigger lever 20, thus causing trigger lock 63 to disengage from the corrugations of ratchet plate 66. Lock spring 64 pulls trigger lock 63 up toward trigger lever 20, enabling trigger lever 20 to fall toward trigger guard 37, and release spring 52 simultaneously pulls trip rod 51 toward solenoid 32, as shown in FIG. 5A. Under any conditions, collar 53 is not able to reattach to plunger pin 70 while plunger pin 70 is withdrawn into housing 72. The ability of trigger lever 20 to actuate valve 26 is not regained until plunger pin 70 is again extended from neck 74.

Dispensing from device 10 is resumed depending on the programming of electronics 84. In one embodiment of the invention, electronics 84 is programmed to return plunger pin 70 to the extended position after a pre-programmed amount of time so that a subsequent job order can be manually processed by device 10. For example, an operator employs interface 22 to set device 10 to dispense a preset amount of fluid to fulfill a job order. In another embodiment, electronics 84 is programmed to retain plunger pin 70 within housing 72 until a subsequent job order is received, either manually from an operator or automatically from a central control system over the communications network. For example, a new job order is automatically processed by electronics 84 after receiving instructions form a central control system, such as a PC workstation connected to a network. This embodiment provides a security feature to device 10 that prevents unauthorized dispensing from device 10, as any further manipulation or retention of the position of trigger lever 20 by an operator will not open valve 26 without authorization form the central control system. Furthermore, the linkage between trip rod 51 and trigger lever 20 at pin 56 is concealed and protected within platform 12 behind guard 57. Guard 57 can only be removed from platform 12 by force so as to fracture tabs 58 (FIG. 2). Thus, tampering of trip rod 51 leaves visible indications that provide a deterrent effect.

In any event, when a new job order is received by electronics 84, electronics 84 applies an appropriate positive voltage across solenoid 32 to extend plunger pin 70 to engage collar 53 and bearings 54. Subsequently, trigger 20 can be actuated to begin the dispensing process, and trigger lock 63 can be employed to permit device 10 to continue to dispense the fluid until the preset volume is reached. After the threshold volume of fluid is dispensed, electronics 84 applies a negative voltage across solenoid 32 to withdraw plunger pin 70 from collar 53, causing trip rod 51 to slide downward within bore 55, trigger lock 63 to be disengaged, trigger lever 20 to be returned to the un-actuated position, and valve 26 to close, stopping the flow of fluid from device 10. Subsequent dispensing of fluid from device 10 by manipulation of trigger lever 20 is regulated by trigger release mechanism 30, which provides added security to fluid inventories. Trigger release mechanism 30 can thus be combined with other inventory control systems, such as fluid tank level monitors, to gain greater control over fluid inventories and to assist in reducing inventory shrinkage. With the use of latching solenoids, the present invention also provides enhanced power saving capabilities. Solenoid 32 only requires intermittent activation to switch the position of plunger pin 70, avoiding the need for continuous power to dispense fluid from device 10.

Although the present invention has been described with reference to preferred embodiments, workers skilled in the art will recognize that changes may be made in form and detail without departing from the spirit and scope of the invention.

The invention claimed is:

1. A hand-held flow metering device for dispensing a pressurized fluid, the device comprising:

a platform comprising:

a blind end valve bore extending into the platform;

a high pressure fluid passage extending along a first axis that is centered on the blind end valve bore;

a low pressure fluid passage extending along a second axis that is tangent to the blind end valve bore; and a release bore extending into the platform spaced from the low pressure fluid passage;

a valve disposed within the blind end valve bore and connected to the pressurized fluid for regulating flow of the pressurized fluid through the device;

a flow meter disposed within the flow of pressurized fluid to measure volumetric flow of the pressurized fluid;

a trigger lever configured to be manually displaced to mechanically open the valve;

a trigger release mechanism disposed within the release bore and connected to the trigger lever and selectively actuated to mechanically prevent the trigger lever from opening the valve when the trigger lever is displaced; and meter electronics connected to the flow meter and the trigger release mechanism to actuate the trigger release mechanism based on output of the flow meter.

2. The hand-held flow metering device of claim 1 wherein the trigger release mechanism comprises:

a solenoid;

a plunger pin linearly actuated by the solenoid to move from a first position to a second position; and a trip rod having a first end releasably connected to the plunger pin in the first position, and a second end pivotably connected to the trigger lever.

3. The hand-held flow metering device of claim 2 wherein the first end of the trip rod comprises:

a collar;

a plurality of bores extending through the collar; and a plurality of ball bearings disposed within the plurality of bores;

wherein the plunger pin pushes the plurality of ball bearings into the plurality of bores to inhibit linear displacement of the trip rod when in the first position.

4. The hand-held flow metering device of claim 3 wherein the trip rod includes a release spring to bias the collar toward the solenoid.

5. The hand-held flow metering device of claim 4 and further comprising a trigger lock connected to the trigger, the trigger lock comprising:

a jack plate pivotably extending from the trigger lever from a first pin;

a lock spring positioned around the first pin to bias the jack plate toward the trigger lever; and a ratchet plate extending from the trigger lever from a second pin to engage the jack plate.

6. The hand-held flow metering device of claim 5 wherein the trip rod is oriented to produce displacement of the trigger lever along a vector having components parallel with and perpendicular to a line of actuation of the dispensing valve.

7. The hand-held flow metering device of claim 3 wherein the plunger pin includes a ramped surface for engaging the plurality of ball bearings.

8. The hand-held flow metering device of claim 3 wherein the plurality of bores in the collar are constricted to prevent the plurality of ball bearings from falling into the collar.

9. The hand-held flow metering device of claim 3 wherein the solenoid comprises a latching solenoid.

10. The hand-held flow metering device of claim 3 wherein the meter electronics actuate the plunger pin from the first position to the second position after the flow meter measures a preset amount of volumetric flow of the pressurized fluid.

11. The hand-held flow metering device of claim 3 wherein the meter electronics actuate the plunger pin from the second position to the first position after receiving authorization from a communications network.

12. The hand-held flow metering device of claim 1 wherein:

the high pressure fluid passage comprises:

a first inlet end positioned at an exterior of the platform to receive the pressurized fluid; and a first discharge end extending into the platform to intersect the blind end valve bore;

wherein the high pressure fluid passage extends from the first inlet end to the first discharge end along the first axis;

the low pressure fluid passage comprises:

a second discharge end positioned at an exterior of the platform to discharge the pressurized fluid from the flow metering device; and a second inlet end extending into the platform to intersect the blind end valve bore;

wherein the low pressure fluid passage extends from the second inlet end to the second discharge end along the second axis; and the release bore extends into the platform adjacent the low pressure fluid passage and in line with the high pressure fluid passage and the blind end valve bore.

13. A flow metering device for dispensing a pressurized fluid, the device comprising:

a platform including:

an internal fluid passage extending through the platform to receive the pressurized fluid;

a blind end valve bore extending into the platform to intersect fluid passage; and a release bore extending through the platform adjacent the valve bore;

a valve disposed in the valve bore to regulate flow of the pressurized fluid through the fluid passage, the valve having a linearly actuated valve stem extending from the valve bore;

a release mechanism connected to the release bore, the release mechanism comprising:

a solenoid connected to the platform atop the release bore;

a plunger pin emanating from the solenoid to extend into the release bore, the solenoid configured to linearly actuate the plunger pin between a first position and a second position; and a trip rod disposed within the release bore and having a first end releasably connectable to the plunger pin, and a second end;

a trigger lever pivotably connected to the second end of the trip rod and extending to engage the valve stem; and a frangible cover plate connected to the platform to restrict access to the second end of the trip rod, the frangible cover plate including tabs that hold the frangible cover plate over the release bore and that must be broken to remove the cover plate;

wherein, in the first position, the plunger pin is coupled to the first end of the trip rod such that the second end of the trip rod provides a fixed pivot point to enable actuation of the trigger lever to actuate the valve; and wherein, in the second position, the plunger pin is uncoupled from the trip rod such that the trip rod is slidable within the release bore by actuation of the trigger lever.

14. The flow metering device of claim 13 wherein the trip rod further comprises:

a collar positioned at a first end of the trip rod;

a plurality of tapered bores extending through the collar; and a plurality of ball bearings disposed within the plurality of tapered bores;

wherein the plunger pin extends to the first position to wedge the plurality of ball bearings between plunger pin and the release bore to inhibit linear displacement of the collar.

15. The flow metering device of claim 14 and further comprising:

a release spring surrounding the trip rod within the release bore to bias the collar toward the solenoid;

a valve spring disposed within the valve bore between the valve stem and the platform to bias the valve to a closed position; and a trigger lock comprising:

a jack plate pivotably extending from the trigger lever from a first pin;

a lock spring positioned around the first pin to bias the jack plate toward the trigger lever; and a ratchet plate extending from the trigger lever from a second pin to engage the jack plate.

16. The flow metering device of claim 15 wherein a line of actuation of the plunger pin is disposed to intersect a line of actuation of the valve stem at an acute angle such that movement of the trip rod in the release bore produces rotation of the trigger lever about the valve stem.

17. The flow metering device of claim 13 and further comprising:

a flow metering device disposed within the internal passage to measure volumetric flow of the pressurized fluid; and meter electronics connected to the solenoid and the flow metering device, the meter electronics comprising a display, a user interface, and communication circuitry configured to regulate fluid flow through the dispensing meter.

18. The flow metering device of claim 17 wherein the meter electronics actuate the plunger pin from the first position to the second position after the flow meter measures a preset amount of volumetric flow of the pressurized fluid.

19. The flow metering device of claim 17 wherein the meter electronics actuate the plunger pin from the second position to the first position after receiving authorization through the communication circuitry.

20. A trigger release mechanism for a flow metering device having a valve stem linearly actuated by a trigger lever, the trigger release mechanism comprising:

a solenoid;

a plunger pin emanating from the solenoid, the plunger pin comprising:

a first end disposed within the solenoid;

a second end comprising a tip; and a ramped shaft extending between the first end and the second end, the ramped shaft being ramped down from the first end to the second end;

wherein the solenoid is configured to linearly actuate the plunger pin between a first extended position and a second retracted position;

a trip rod having a first end releasably connectable to the plunger pin, and a second end connectable to the trigger lever, the trip rod comprising:

a collar positioned at a first end of the trip rod, the collar comprising an outer diameter and an inner diameter configured to receive the plunger pin;

a plurality of bores extending through the collar, each of the plurality of bores comprising a first end in the outer diameter and a second end in the inner diameter, the first end having a larger diameter than the second end; and a plurality of ball bearings disposed within the plurality of bores and configured to surround the plunger pin around the ramped shaft when the plunger pin is in the first extended position; and a release spring surrounding the trip rod adjacent the collar to bias the trip rod toward the solenoid.

21. The trigger release mechanism of claim 20 wherein the plurality of bores are tapered to prevent the plurality of ball bearings from moving completely into the collar.

22. The trigger release mechanism of claim 20 wherein the plunger pin includes a ramped end for engaging the plurality of ball bearings.

23. The trigger release mechanism of claim 20 wherein the solenoid comprises a latching solenoid.

* * * * *